United States Patent [19]

Frank

[11] Patent Number: 4,533,205

[45] Date of Patent: Aug. 6, 1985

[54] COLLAPSIBLE WEDGE FOR ELECTRICAL CONNECTOR

[75] Inventor: Walter Frank, Darien, Conn.

[73] Assignee: Burndy Corporation, Norwalk, Conn.

[21] Appl. No.: 681,075

[22] Filed: Dec. 12, 1984

Related U.S. Application Data

[63] Continuation of Ser. No. 431,916, Sep. 30, 1982, abandoned.

[51] Int. Cl.[3] ..... H01R 13/24

[52] U.S. Cl. ..... 339/247; 339/273 F

[58] Field of Search ..... 339/247, 252 R, 273 R, 339/273 F

[56] References Cited

U.S. PATENT DOCUMENTS 3,329,928 7/1967 Broske ..... 339/247

FOREIGN PATENT DOCUMENTS 2119567 11/1971 Fed. Rep. of Germany ... 339/17 M

*Primary Examiner*—Gil Weidenfeld
*Assistant Examiner*—Gary F. Paumen
*Attorney, Agent, or Firm*—Howard S. Reiter

[57] ABSTRACT

A collapsible wedge for use in electrical connector assemblies which increases the range of conductor sizes that can be used therewith. The wedge contains ribs which, upon the application of a pre-determined force, enables the size of the wedge to shrink uniformly while maintaining its wedge shape. The wedge is used with a shell to form an electrical connection. Electrical conductors are placed inside the shell and the collapsible wedge is driven therebetween. The wedge has stops which consistently located it horizontally in the shell. As the force on the wedge reaches a predetermined value, the wedge collapses in a uniform manner thereby automatically adjusting its size to accommodate the size of the conductor and securely attaching the conductor to the shell.

11 Claims, 5 Drawing Figures

COLLAPSIBLE WEDGE FOR ELECTRICAL CONNECTOR

This is a continuation of co-pending application Ser. No. 06/431,916 filed on Sept. 30, 1982, now abandoned.

This invention generally relates to an electrical connector assembly having an outer shell and an inner wedge for attaching conductors thereto, and more particularly, to a collapsible wedge member designed to allow the connector assembly to accomodate a large range of conductor sizes.

Wedge-type electrical connector assemblies are widely used for joining electrical conductors, such as solid and stranded wires, insulated wires and the like, either at the ends of the conductors or at a point intermediate of the ends of the conductors. The connector normally includes two components; an outer shell and a solid, wedged-shaped inner member. The shell is typically formed as a C-shaped member having an internal taper corresponding to the wedge shape. Both the shell and the wedge contain surfaces to enable the conductor to properly seat therebetween during assembly, and, after assembly, to make a secure electrical connection. Assembly is carried out by placing a pair of conductors into the shell and the wedge therebetween. The wedge is then driven into the shell between the two conductors to secure the shell, conductors and wedge together. The resulting assembly makes a secure, reliable electrical connection.

Although it may be possible to accommodate some different conductor sizes with prior art wedge-type connectors of given dimensions, any such range of sizes, in practical terms, must be kept relatively small to assure appropriate seating by the conductors between the wedge and shell. After seating, of course, the sedge and shell should maintain sufficient bearing surface on the conductors for the efficient transfer of electrical current.

In prior art wedge-type connector assemblies, the size of the wedge used is matched with the size of the shell. Furthermore, the wedge and shell assembly has to be closely matched to the size of the conductor being assembled because of the wedge geometry. If a prior art wedge and shell combination were attempted to be used over a relatively large range of conductor sizes, the wedge could not be properly assembled with the shell. The contact area between the conductors and connector components would be less than required for a good connection from both the mechanical and electrical viewpoints. The greater the departure from the matched conductor size, the smaller the contact area between the wedge and shell and conductor after assembly. Since such size departure tends to produce weak and insecure connections, manufacturers, to avoid unnecessary risks associated therewith, limit the sizes of conductors that a particular connector assembly can be used with to a very small range.

There are two aspects of the wedge's design which could be varied to enable a larger range of conductors and possibly still maintain the requisite contact between the conductors and connector. The first aspect is the angle of the wedge. If the compound angle of wedge were increased, a larger range of conductor sizes might be assembled with a given connector. However, increasingly steeper angles on the wedge have the disadvantage of requiring a greater mechanical advantage to assemble the wedge with the shell. The second aspect is the length of the wedge. However, increasingly greater lengths for the wedge results in the wedge becoming too cumbersome to quickly and readily assemble with the shell and conductors.

Accordingly, it is a primary object of the present invention to expand the range of sizes of conductors that can be accommodated by an electrical connector assembly.

It is another object of the present invention to provide a collapsible wedge which can accommodate a larger range of conductor sizes.

It is another object of the present invention to provide a wedge which assures proper seating of the conductor between the wedge and shell upon assembly over a large range of conductor sizes.

SUMMARY OF THE INVENTION

Briefly stated, and in accordance with the present invention, there is provided a collapsible wedge for use in electrical connector assemblies which accommodates a larger variety of conductor sizes than possible heretofore. The wedge is designed to adjust its size to accommodate the particular size of conductor placed in the shell. The wedge size is automatically adjusted as it is installed into the shell and conductors. The wedge collapses in a uniform manner whereby its size lessens while its overall wedge angle is maintained during installation.

BRIEF DESCRIPTION OF THE DRAWINGS

Other objects and advantages of the present invention will become apparent upon reading the following detailed description with reference to the drawings in which.

DETAILED DESCRIPTION OF THE INVENTION

The present invention is used in electrical connectors of the type having an outer shell and an inner wedge. The shell is made of any suitable material and in any convenient external shape, such as C-shaped when viewed through its cross-section. The C-shaped shell is particularly useful when a connection is made intermediate the ends of a conductor. The interior length of the C-shaped shell tapers from one end to the other and should generally correspond with the shape of the wedge. This can be accomplished by making the shell from a uniform cross-sectional material and then "jogging" it to mechanically form the taper.

Those surfaces of the shell and wedge that contact the conductors can take on any suitable shape. Preferably, the shapes of these surfaces should generally correspond with the shape of the conductor, or, if not, should be capable of good holding action on the conductor. For instance, if round conductors, such as wires, are used in the assembly, the wedge and shell can have round or curved surfaces thereon to seat firmly against the conductors upon final assembly. In some application, however, a V-shaped surface of other suitable shape whould be preferable even though a round conductor is used. To make the connection, the conductors are placed into the shell and the wedge is then driven into the shell between the two conductors. The conductors become firmly and securely located between the interior wall of the shell and the wedge in final assembly.

The function of the collapsible wedge described herein is to provide a wedge connector that can accommodate a relatively large number of conductor sizes. The wedge, upon assembly into its associated shell, collapses to automatically adjust its size to accommodate the particular conductor. The collapsing action is done uniformly so that the wedge maintains its general shape. Suitable hydraulic or explosive tools, well known in the prior art, can be used to drive the wedge into the shell. The collapsible wedge is particularly desirable in utility applications wherein the conductors have relatively large diameters. However, its use is not restricted to this application and it can be used in all types of applications including those using small conductors.

Figure 1:
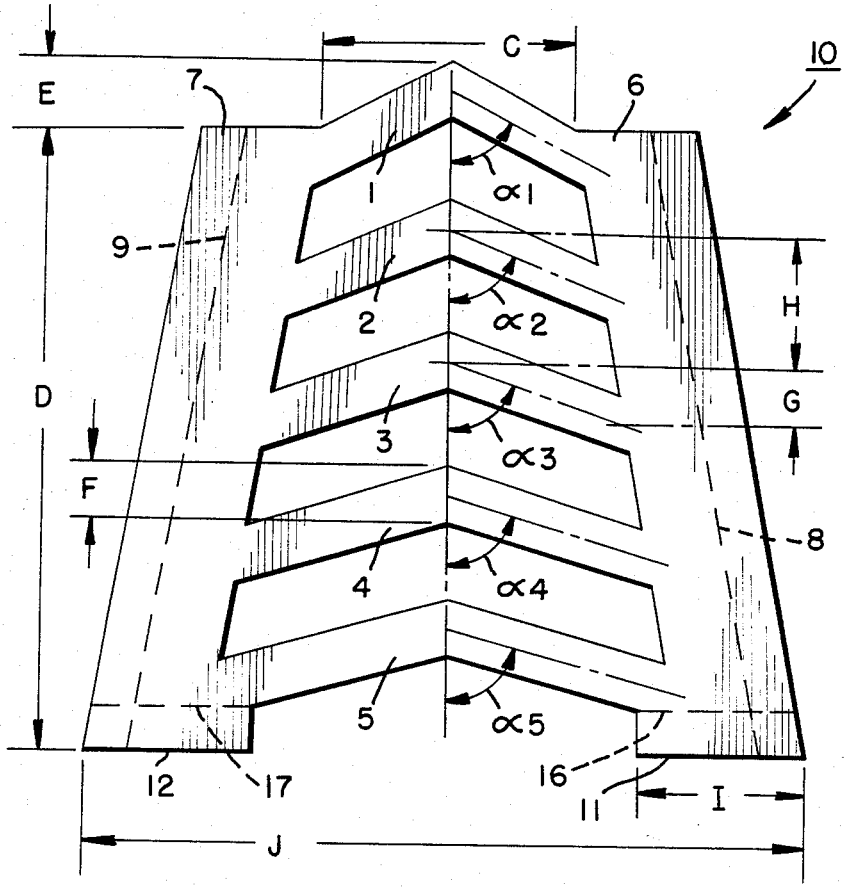
FIG. 1 schematically illustrates a preferred embodiment of the collapsible wedge.
Figure 2:
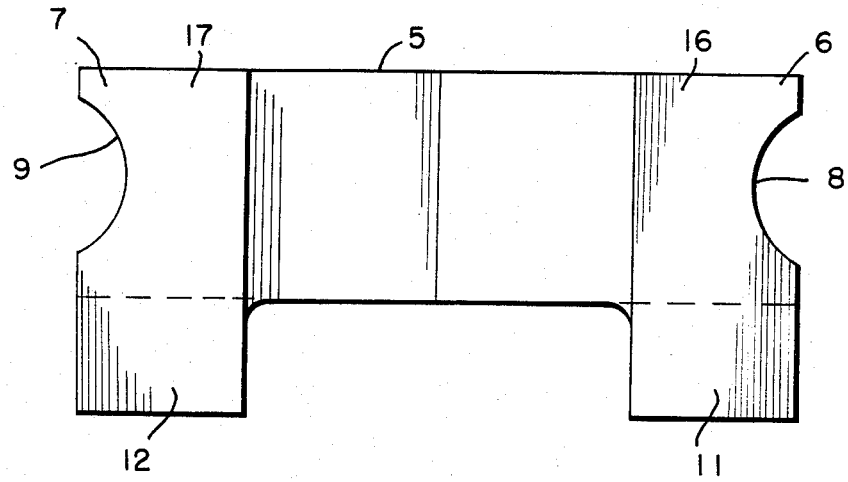
FIG. 2 is a side view of the wedge shown in FIG. 1.

Referring to FIG. 1, wedge 10 is shown as a collapsible one-piece design. The collapsible feature, in this embodiment, is provided by special collapsible means in the wedge, ribs 1–5. The length of each rib varies because of the wedge shape. The design and size of the ribs in the wedge are selected so that the wedge collapses uniformly along its entire length at a given load. Proper material and hardness selection for the wedge results in collapse of the ribs without rupture.

Figure 4:
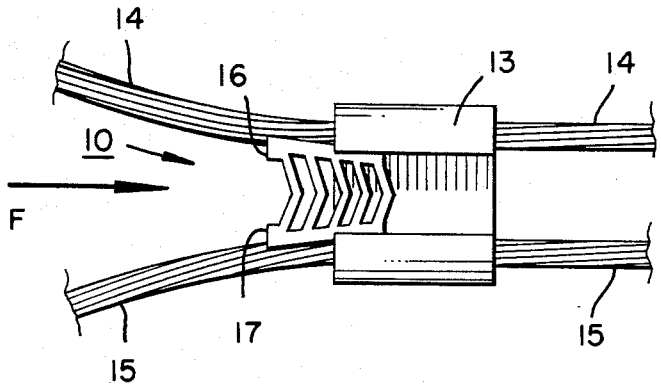
FIG. 4 schematically illustrates the manner in which the wedge is installed into the shell between the conductors.

The force that drives the wedge into the shell and between the conductors is also sufficient to bring the wedge into the shell to its completely installed position. FIG. 4 shows wedge 10 placed or pre-assembled between conductors 14 and 15 which are, in turn, retained by shell 13. After such pre-assembly of the connection components, installation force "F" is applied to the large end of the wedge. This force is applied by any suitable means; for instance, manually by a hammer. The end of the wedge provides a surface 16 and 17 upon which the external force "F" can be received on the wedge.

Figure 5:
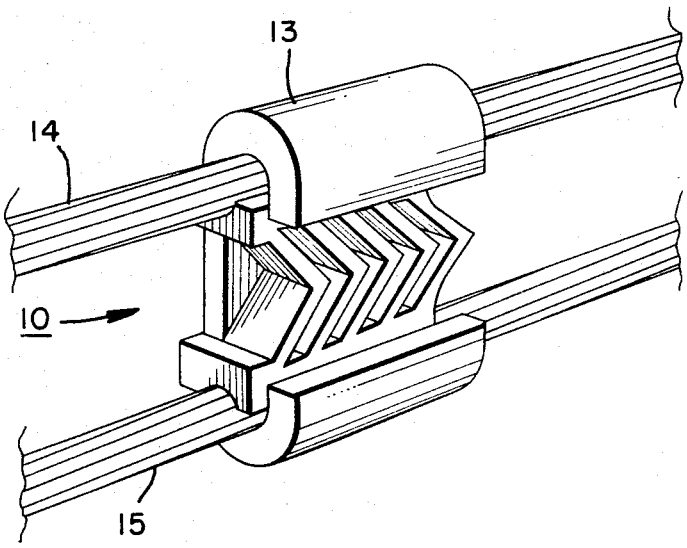
FIG. 5 schematically illustrates the wedge, shell and conductors after final assembly.

FIG. 5 shows the same elements after installation. The fully installed position of the wedge is determined when stops 11 and 12 on the wedge contact the edge of the shell. These stops consistently locate the wedge horizontally at its fully installed position. Wedge 10 also contains two cable contact surfaces, 8 and 9, which are adapted to provide good mechanical and electrical contact between the wedge and conductors after final assembly. The cable contact surfaces can take any suitable shape and, in the case of the embodiment shown, are curved surfaces which mate well with round conductors. The surfaces are preferably uniform along the length of sides, or edges 6 and 7, of the one-piece wedge.

Instead of having a solid cross-section for the wedge, as used in prior art devices, the wedge herein contains a multible ribbed, collapsible section between the cable contact surfaces. When force is applied to drive the wedge into the shell between the conductors, the ribs preferably collapse uniformly over the entire length of the wedge at a predetermined load. The ribs preferably collapse at approximately the same loading for any size conductor adapted to be used with the collapsible wedge. Thus, the force required to install the wedge into its shell for all conductors in its useful range should be approximately the same.

During the installation process, the conductors become compressed between the inner wedge member and outer shell. The space between the wedge's conductor contact surfaces and the shell's conductor contact surfaces varies as the ribs collapse so that the wedge size self-adjusts in accordance with the particular size of the conductors. Once the wedge has collapsed and is fully installed, it has sufficient retained strength to securely hold the conductor against the shell for good mechanical and electrical contact.

Figure 3:
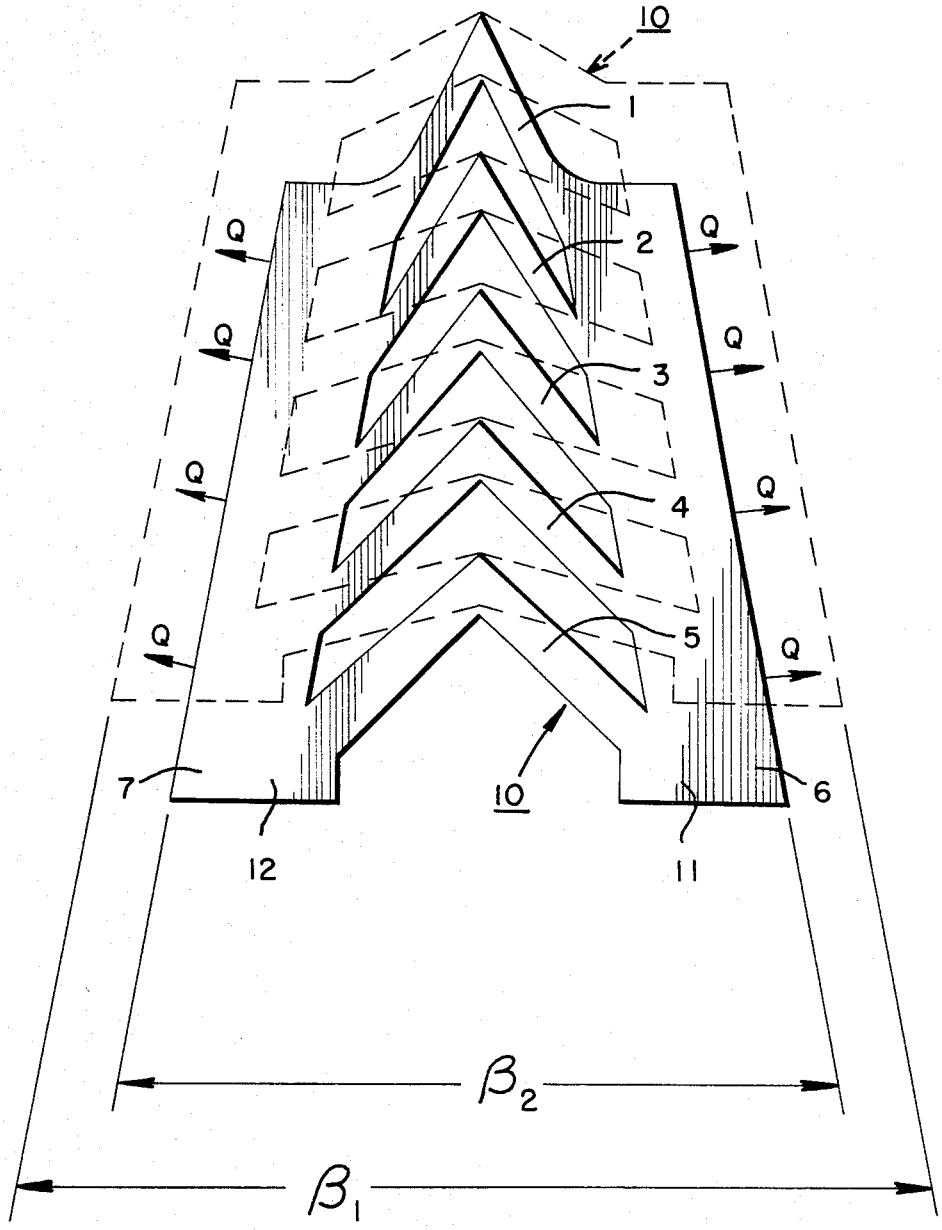
FIG. 3 is a schematic drawing (not to scale) of the wedge before and after installation.

FIG. 3 illustrates the wedge in FIG. 1 after it has been partially collapsed. The dotted lines represent the wedge before it is driven into the shell while the solid lines roughly approximate its shape after it has collapsed to some degree. It is noted that the taper of the wedge, as represented by $B_1$ and $B_2$, is preferable approximately the same before and after collapse, the wedge thereby maintaining its general overall shape. Ribs 1–5 "nest" together to a degree as the collapsing process takes place. If a large degree of collapse is carried out during the installation step due to the particular size of conductors used, the ribs may even reach the point of contacting each other after installation. However, it is not necessary for such contact to occur. For clarity of description, the wedge shown in solid lines in FIG. 3 shows the ribs beginning to nest, but not quite in contact with one another, at the state of collapse depicted.

Before installation, the ribs are off-set, as best seen in FIG. 1, at an angle relative to the center-line running through the wedge. Each rib makes an angle with the center-line shown by "$\alpha$". Rib 1 is off-set at an angle of $\alpha_1$, rib 2 an angle "$\alpha_2$" and so on through the five ribs depicted in this embodiment.

The number of ribs in a particular wedge must be at least two and the exact number can be chosen to effect the collapsing force and action required. The portion of the wedge below the center-line in FIG. 1 is a mirror image of that above the center-line.

The off-set of the ribs, represented by $\alpha$, preferably increases as one moves from rib 1 to rib 5; that is, from the small to the large end of the wedge. The ribs are off-set in this embodiment such that they "point" in the direction facing the small end of the tapered wedge. The ribs should be off-set in one direction or the other; that is, they should either point towards the small or the large end of the wedge. Good results were obtained by having them point towards the small end of the wedge for a smooth collapsing action as the wedge is installed. The wedge is certain to collapse in the proper direction when the ribs point to the small end of the wedge.

The cross-section of the ribs can be any suitable size. However, it is preferable to keep the cross-section of all the ribs within a wedge approximately the same size. The cross-section of the ribs and the offset of each rib can be varied to adjust the installation force required to collapse the wedge in the shell. The lesser the angle or taper of the wedge, the lesser the installation force for a given contact force "Q", simulated in FIG. 3, placed on the conductor by the wedge after installation.

It is preferable to make a uniform load to collapse all the ribs. For instance, if a total force of 4,000 lbs. were placed on the conductor surface of the wedge to install it into the shell, the five ribs shown in FIG. 1 should be designed so that approximately 800 lbs. force acts to collapse each of the ribs in unison.

A wedge used with larger conductors generally needs more ribs and this has to be balanced with the geometry of the ribs. The number of ribs also affects the maintenance of the general geometry of the wedge during installation. The greater the number of ribs, the better the wedge retains its overall shape while collapsing.

An example of a specific wedge which has performed in the manner described is as follows. The material used to construct the wedge was 6061T6 Aluminum. The wedge was approximately 1.88 inches long and contained 5 ribs. The approximate angles of the ribs were as follows: $\alpha_1=62\frac{1}{2}°$, $\alpha_2=67°$, $\alpha_3=69°$, $\alpha_4=71\frac{1}{2}°$, and $\alpha_5=73\frac{1}{2}°$. The thickness of the wedge was approximately 0.68 inches. The other approximate dimensions of various aspects of the wedge, as shown in FIG. 1, were as follows: C=0.75 in., D=1.88 in., E=0.19 in., F=0.16 in., G=0.19 in., H=0.40 in., I=0.75 in., J=2.18 in. All of the dimensions above are intended to be representative and are, in no way, intended to limit the invention or the parameters within which the invention can operate.

It is preferred that the cross-section and preset angle of the ribs be selected to enable the ribs to collapse under the lowest load which will result in a low resistance stable electrical connection. However, the collapsed wedge must maintain a sufficient residual force on the conductors to maintain a low resistance connection during all expected variations of temperature and other adverse operating conditions.

As force "F" is applied to assemble the wedge into the shell, as in FIG. 4, the wedge reaches a predetermined point at which the load thereon begins to collapse the ribs approximately uniformly about their center-line thereby enabling the side members of the wedge to move closer together. This has the effect of shrinking the overall size of the wedge while maintaining its overall wedge shape and angle and automatically adjusting the wedge size to accommodate the size of the conductor. Bending normally occurs about the center-line of the wedge and at the point where each side of each rib joins the side members. Because of the wedge design, the side members compress the ribs fairly uniformly and the point of the ribs is driven further in the direction of offset. Dimension G, shown in FIG. 1, is meausred between the mid-section of the rib where it meets the side members and the mid-section of the rib where it meets the wedge center-line. This dimension increases as the wedge collapses and similar increases occur in all the ribs as they collapse while maintaining the overall wedge angle.

Changes in construction will occur to those skilled in the art and various modifications and embodiments may be made without departing from the scope of the invention. For instance, it is possible to modify the connector assembly to take only one conductor or, to accommodate more than two conductors. It is possible to modify various parts of the wedge without departing from the overall wedge shape to provide the same function as described herein. It is possible to manufacture the wedge as an assembly by joining together a number of parts rather than having the wedge made from one piece of stock. It is also possible to use existing commercially available shells with the wedge, or to design a complimentary shell especially for the collapsible wedge.

It should be understood that the foregoing description is only illustrative of the invention. Various alternatives and modifications of the structural and functional features of the wedge can be devised by those skilled in the art without departing from the invention. Accordingly, the present invention is intended to embrace all such alternatives, modifications, and variances which fall within the spirit and scope of the appended claims.

What is claimed is:

1. A wedge connector for holding a range of sizes of electrical conductors betwen an inner wedge member and a mating outer shell member, comprising: A wedge-shaped outer shell member having a generally "C" shaped cross-section forming a pair of diverging opposed inner contact surfaces for receiving a pair of electrical conductors and a mating wedge member therein; and a wedge member having a small end and a large end with a given length therebetween, said wedge member further comprising:

(a) A pair of diverging contact portions each extending in the lengthwise direction of said wedge from the small end to the large end, and each having a contact surface thereon for holding conductors against the outer shell member upon insertion of the wedge into the shell;

(b) a plurality of discrete ribs extending between the contact portions, spaced from each other in the lengthwise direction of said wedge, and each having a lengthwise dimension less than said given length;

(c) a first one of said ribs being located proximate the small end of said wedge and a second one of said ribs being located proximate the large end;

(d) each of said ribs having an offset between said contact portions which is displaceable in the lengthwise direction of said wedge, as said ribs are forced to collapse; and (e) said ribs collapsing as said contact portions are displaced toward each other upon insertion of said wedge member into said outer shell member, thereby decreasing the spacing between the contact surfaces of said wedge so as to accommodate conductors of increasing size between said wedge member and said outer shell member.

2. The wedge connector of claim 1 wherein said ribs are substantially V-shaped, and the vertex of said V defines said offset.

3. The wedge connector of claim 2 wherein the offsets of said ribs all extend in substantially the same direction.

4. The wedge connector of claim 1 wherein the heights of said ribs are unequal, the height of each rib being measured in a direction substantially transverse to the lengthwise direction of said wedge.

5. The wedge connector of claim 1 wherein the configuration of each rib is selected so that the wedge collapses uniformly along its length at a given load.

6. A collapsible wedge having a small end and a large end for use in an electrical connection of the type wherein said wedge is insertable into a shell member having a mating wedge shape therein and at least one conductor therein to form the electrical connection, said wedge being adjustable to a range of conductor sizes by collapsing as it is inserted into said shell to accommodate the particular size of conductor within the shell, said wedge comprising:

(a) two opposed unitary side members for securing conductors, said side members joined by a plurality of spaced ribs therebetween, said side members being held by said ribs in wedge shape, said wedge having a centerline about which the ribs and sides are substantially symmetrical; and (b) said ribs being offset at approximately said centerline of the wedge and bendable substantially about said centerline and at the places where said ribs are joined to said side members whereby said wedge collapses uniformly along its length in adjusting itself to accommodate said particular size of conductor within said shell when installed therein.

7. The wedge of claim 6 wherein said offset of said ribs increases from the smaller end to the larger end of said collapsible wedge.

8. The wedge of claim 6 wherein said offset of said ribs is in the direction of the smaller end of the collapsible wedge.

9. The wedge of claim 6 wherein the surfaces of said sides adapted to be placed adjacent said conductors are shaped to mate with said conductors.

10. The wedge of claim 6 wherein the large end of the collapsible wedge has stop means thereon.

11. The wedge of claim 6 wherein said ribs are of substantially the same cross section.

* * * * *